US010957289B2

(12) United States Patent
Laird

(10) Patent No.: US 10,957,289 B2
(45) Date of Patent: Mar. 23, 2021

(54) HOLDER FOR MUSICAL INSTRUMENT

(71) Applicant: Thomas G. Laird, Marlton, NJ (US)

(72) Inventor: Thomas G. Laird, Marlton, NJ (US)

( * ) Notice: Subject to any disclaimer, the term of this patent is extended or adjusted under 35 U.S.C. 154(b) by 0 days.

(21) Appl. No.: 16/845,174

(22) Filed: Apr. 10, 2020

(65) Prior Publication Data

US 2020/0327870 A1 Oct. 15, 2020

Related U.S. Application Data

(60) Provisional application No. 62/832,578, filed on Apr. 11, 2019, provisional application No. 62/940,401, filed on Nov. 26, 2019.

(51) Int. Cl.
*G10G 5/00* (2006.01)

(52) U.S. Cl.
CPC ..... *G10G 5/005* (2013.01)

(58) Field of Classification Search
None
See application file for complete search history.

(56) References Cited

U.S. PATENT DOCUMENTS 2,244,790 A * 6/1941 Maier ..... G10G 5/005 403/105
2,284,069 A * 5/1942 Robertson ..... G10G 5/005 224/258
2,356,209 A * 8/1944 Brilhart ..... G10G 5/005 224/258
2,561,606 A * 7/1951 Bates ..... G10G 5/005 224/258
3,037,416 A * 6/1962 Cunningham ..... G10G 5/005 84/327
5,215,239 A * 6/1993 Walters, Jr. ..... A45F 5/00 224/259
5,541,358 A * 7/1996 Wheaton ..... G10H 1/00 84/645
5,817,961 A * 10/1998 Beck ..... G10G 5/005 84/327
6,648,197 B2 * 11/2003 Perry ..... G10G 5/005 224/604
9,053,687 B1 * 6/2015 Benson ..... G10D 13/11
9,721,545 B2 * 8/2017 Jancic ..... G10D 9/00
2002/0125278 A1 * 9/2002 Wagmild ..... G10G 5/005 224/268
2006/0010657 A1 * 1/2006 Warren ..... G10G 5/005 24/3.1
2020/0219472 A1 * 7/2020 White ..... G10D 1/08
2020/0327870 A1 * 10/2020 Laird ..... G10G 5/005

* cited by examiner

*Primary Examiner* — Robert W Horn
(74) *Attorney, Agent, or Firm* — Licata & Tyrrell P.C.

(57) ABSTRACT

Devices for players of musical wind instruments with a bell-shaped portion that hold the instrument during play and methods for its use in alleviating strain on the musician and/or assisting the musician with accurate placement of the instrument for optimum playing and/or stabilizing the instrument are provided.

17 Claims, 7 Drawing Sheets

HOLDER FOR MUSICAL INSTRUMENT

This patent application claims the benefit of priority from U.S. Provisional Application Ser. No. 62/940,401 filed Nov. 26, 2019 and U.S. Provisional Application Ser. No. 62/832,578 filed Apr. 11, 2019, the contents of each of which are incorporated herein by reference in their entirety.

FIELD

The present invention relates to devices for musical instrument players that hold the musical instrument during play and methods for its use in alleviating strain on the musician and/or assisting the musician with accurate placement of the instrument for optimal playing and/or stabilizing of the instrument for players in need of such assistance.

BACKGROUND

Musicians practice and perform for countless hours which requires the type of physical endurance that often leads to strain on certain parts of the body, especially the hands. Thus, musicians are prone to developing musculoskeletal injuries that can have a negative impact on their careers. Musicians, who play the horn, trumpet, trombone, flute, clarinet, saxophone and other similar instruments, are prone to hand injuries stemming from strained shoulders or arm injuries. Nerve compression due to incorrect positioning is the precursor to the most common hand injuries developed from playing instruments. The most common nerve related hand injuries include: Carpal Tunnel Syndrome, characterized by feeling of numbness, tingling and weakness on the thumb, index finger, middle finger and half of the ring finger; Cubital Tunnel Syndrome, characterized by tingling and pain on inner elbow, especially when the elbow is bent; Thoracic Outlet Syndrome, characterized by fatigue and numbness of the hand and/or arm with use, aching of limb and coldness or discoloration of the hand; Flexor Tenosynovitis, characterized by numbness of the median innervated fingers during and shortly after playing instruments; Thumb arthritis, characterized by pain to the base of the thumb with pinching and grasping objects; and Tendonitis characterized by inflammation of a tendon leading to severe and debilitating pain, caused by the overuse of a muscle group. (See https: with the extension //urgenthand.com/uncategorized/which-musicians-most-risk-hand-injuries/ of the world wide web).

There is a need for devices which alleviate stress on the hands, arms and shoulders of a musician during playing of the musical instrument and/or place the instrument in proper positioning for optimal play and/or stabilize the instruments for players in need of such assistance.

SUMMARY

An aspect of the present invention relates to support devices for musical instruments, and in particular wind instruments with a bell-shaped portion.

In simplest form the device comprises a hook sized to engage a rim of a bell of the musical instrument at at least one point.

In some nonlimiting embodiments, the hook may further comprise a means in addition to the hook for stabilizing the musical instrument above the bell portion.

The device may further comprise a first arm with a distal end and a proximal end and a hook holder at either the distal or proximal end for swivable attachment of the hook and adjustment of the position of the support device.

Alternatively, in some nonlimiting embodiments, instead of a hook holder, the adjustable support device may comprise a second arm with a proximal end and a distal end attached at its proximal end via a universal joint to the first arm and a hook, and in some embodiments stabilizing means, adjustably attached in an upward and downward direction with respect to the second arm at the distal end of the second arm.

In one nonlimiting embodiment, the adjustable support device is seat mounted. In this nonlimiting embodiment, the device comprises either a plate that fits between a musical instrument player's legs and a seat or another fixing means for attachment of the device to a seat.

In another nonlimiting embodiment, the adjustable support device may be attached to a stand placed in front of the player.

In one nonlimiting embodiment, the first arm of the device is adjustable in an upward or downward direction from its mounted position.

In one nonlimiting embodiment, the first arm is adjustable in an inward or outward direction from its mounted position.

In one nonlimiting embodiment, the arm is adjustable in an upward or downward direction and an inward or outward direction from its mounted position.

Another aspect of the present invention relates to a method for alleviating stress or strain on hands, arms and/or shoulders of a musician during playing of a musical instrument. In this method, the musician either fits the plate of the adjustable seat mounted support device of the present invention between his or her legs and their seat or mounts the device to a seat or stand. The player then adjusts the device so that the musical instrument, when engaged via its bell in the swivably attached hook of the device, and in some embodiments the stabilizing means, is at the proper position for playing by the musician.

Another aspect of the present invention relates to a method for assisting a musician with accurate placement of wind instrument with a bell-shaped portion for optimum playing. In this method, the musician either fits the plate of the adjustable seat mounted support device of the present invention between his or her legs and their seat or mounts the device to a seat or stand. The player then adjusts the device so that the musical instrument, when engaged via its bell in the swivably attached hook of the device, and in some embodiments the stabilizing means, is at the proper position for playing by the musician.

Yet another aspect of the present inventions relates to a method for assisting a musician in need thereof with stabilization of their wind instrument with a bell-shaped portion during play. In this method, the musician either fits the plate of the adjustable seat mounted support device of the present invention between his or her legs and their seat or mounts the device to a seat or stand. The player then adjusts the device so that the musical instrument is engaged via its bell in the hook of the device and secured at a portion of the instrument above the bell in the stabilizing means at the proper position for playing by the musician. This method allows musicians with limited use or no use of one of their arms or hands to still play the instrument.

DETAILED DESCRIPTION

The present invention provides adjustable support devices for wind instruments with a bell-shaped portion and methods for use of these devices in alleviating stress or strain on the hands, arms and/or shoulders of a musician during playing of these musical instruments and assisting a musician with accurate placement of the instrument for optimum playing and/or stabilizing of the musical instrument for players in need thereof during play.

In simplest form the device comprises a hook sized to engage a rim of the bell of the musical instrument at at least one point. In some nonlimiting embodiments, the device may comprise more than one hook which engages with the rim of the bell for additional stabilization.

The hook or hooks may be attached to any adjustable stand such as a microphone stand or music stand which is positioned at the right height in front of the player so that the rim of the bell of the wind instrument with a bell-shaped portion may be held by the hook and the majority of the weight of the instrument is supported by the hook and stand.

Figure 4A:
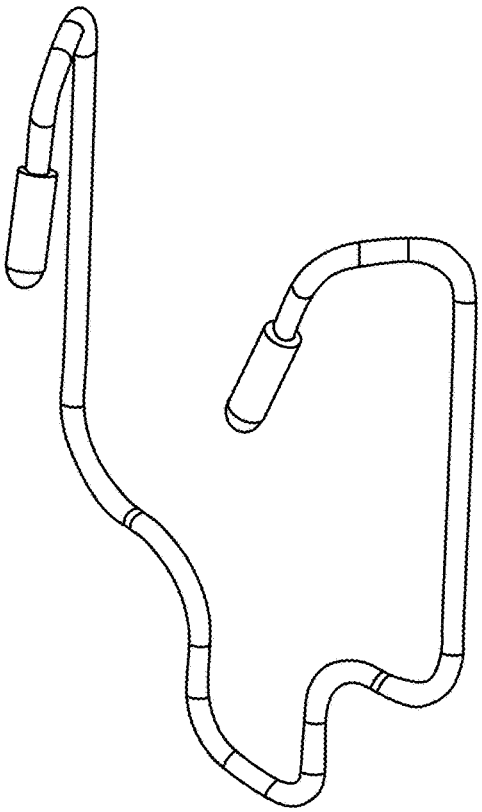
FIGS. 4A and 4B are diagrams of a nonlimiting embodiment of a hook sized to engage a rim of a bell of the musical instrument at at least one point.
Figure 4B:
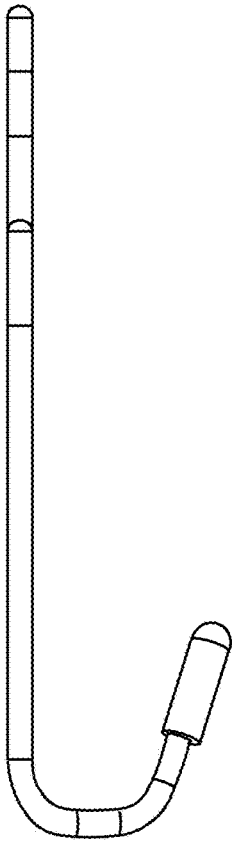

A nonlimiting example of a hook 15 is depicted in FIGS. 4A and 4B.

Figure 5A:
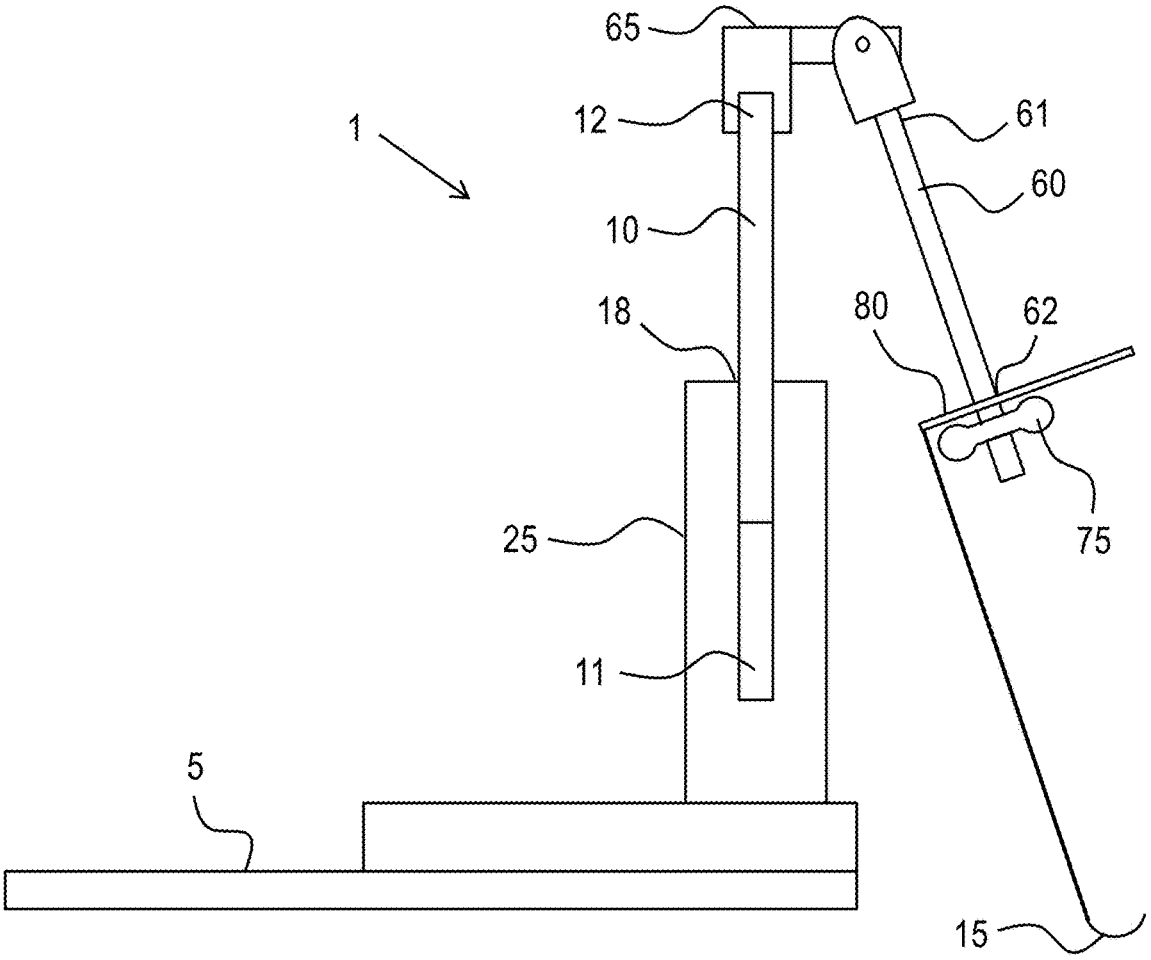
FIGS. 5A and 5B are diagrams of a cross-section (FIG. 5A) and top view (FIG. 5B) of another nonlimiting embodiment of an adjustable seat mounted support device of the present invention with a device with a second arm attached via a universal joint and a hook with stabilizing means attached to the second arm via a stabilizing bar.
Figure 5B:
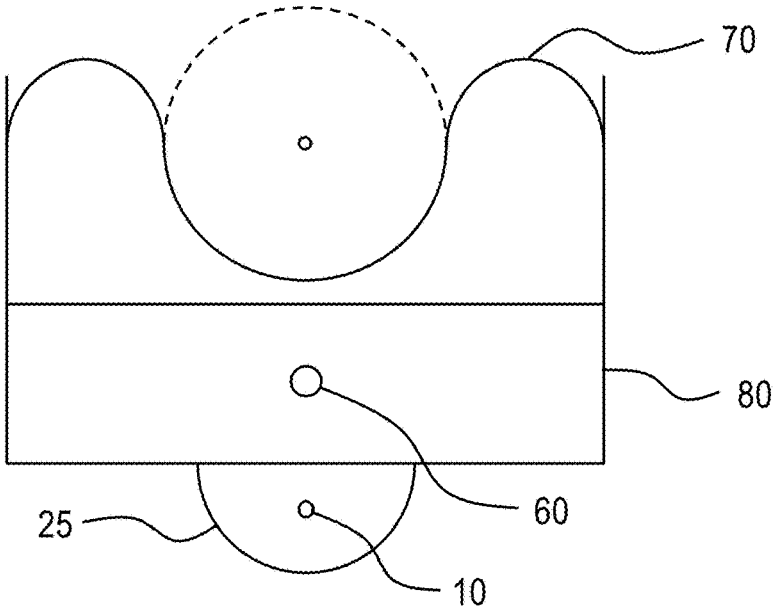

In some nonlimiting embodiments, the hook further comprises a means in addition to the hook for stabilizing the musical instrument above its bell portion. See FIGS. 5A and 5B.

The device may further comprise a first arm with a distal end and a proximal end and a hook holder at either the distal or proximal end for swivable attachment of the hook, and in some embodiments at stabilizing means.

Figure 6:
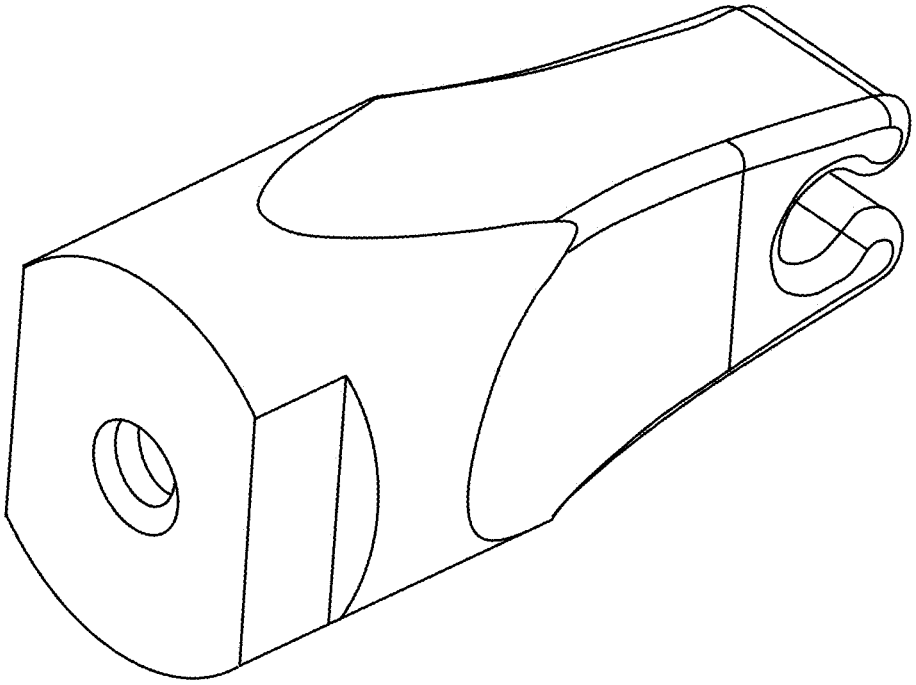
FIG. 6 is a diagram of a hook holder for swivable attachment of the hook.

A nonlimiting example of a hook holder 50 useful in the present invention is depicted in FIG. 6.

Alternatively, in some nonlimiting embodiments, instead of a hook holder, the adjustable support device comprises a second arm with a proximal end and a distal end. The second arm is attached at its proximal end via a universal joint or similar means to the first arm. See FIGS. 5A and 5B. In this nonlimiting embodiment, the hook or hooks, and in some embodiments the stabilizing means, are adjustably attached in an upward and downward direction with respect to the second arm at the distal end of the second arm.

The adjustable support devices of these various embodiments may be attached to any adjustable stand such as a microphone stand or music stand which is positioned at the right height in front of the player or clamped to the seat of a player so that the rim of the bell of the instrument may be held by the hook and the majority of the weight of the instrument is supported by the hook and stand. In some nonlimiting embodiments which further comprise the stabilizing means, movement of the instrument is further stabilized by insertion of a portion of the instrument above the bell in the stabilizing means.

Various means for attachment of the adjustable supporting device to a stand can be used including, but not limited to clamps, screws, clips, etc., and the invention is not limited to any particular means.

In one nonlimiting embodiment, the adjustable support device is seat mounted. In this nonlimiting embodiment, the device comprises either a plate that fits between a player's legs and a seat or another means for attachment of the device to a seat such as, but not limited to, clamps, screws, clips, etc.

Various views and nonlimiting embodiments of seat mounted devices of the present invention are depicted in FIGS. 1A through 5.

As shown in these Figures, in this nonlimiting embodiment, the device 1 comprises a plate 5.

Figure 7B:
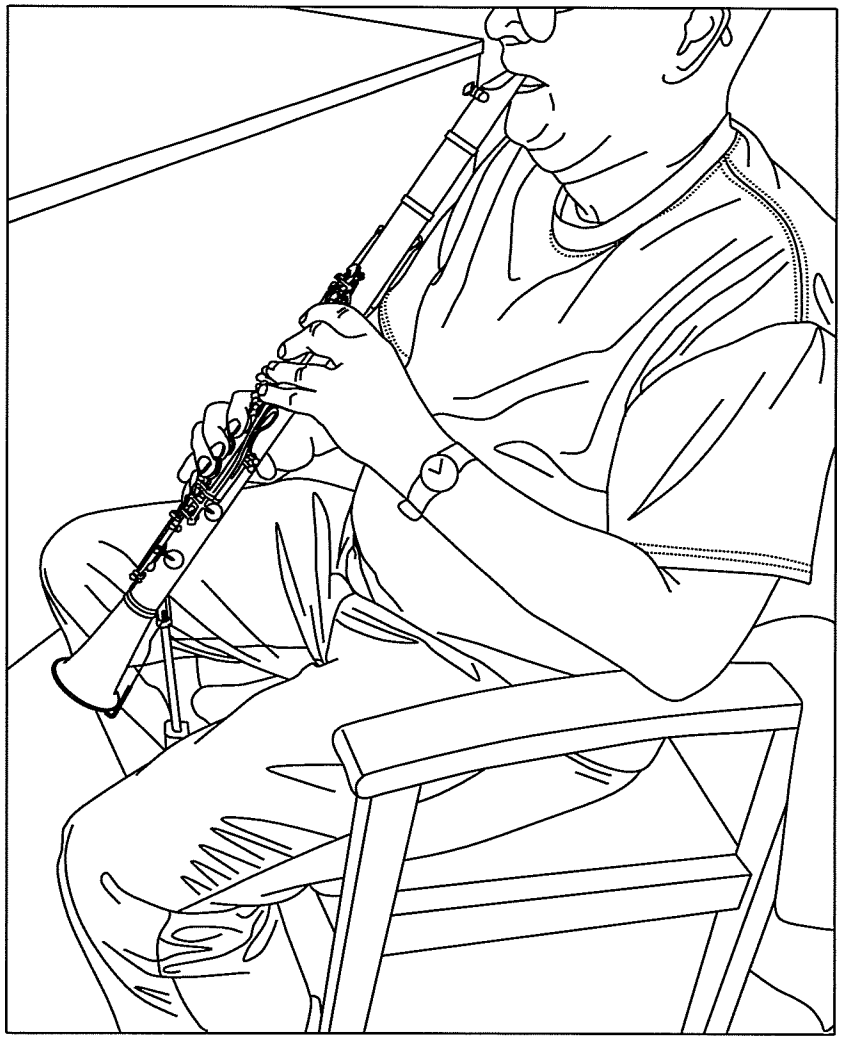
FIGS. 7A and 7B are photographs showing a musician seated with an adjustable seat mounted support device of the present invention positioned between their legs and a seat and the rim of the bell of a clarinet engaged with the hook of the device.
Figure 7A:
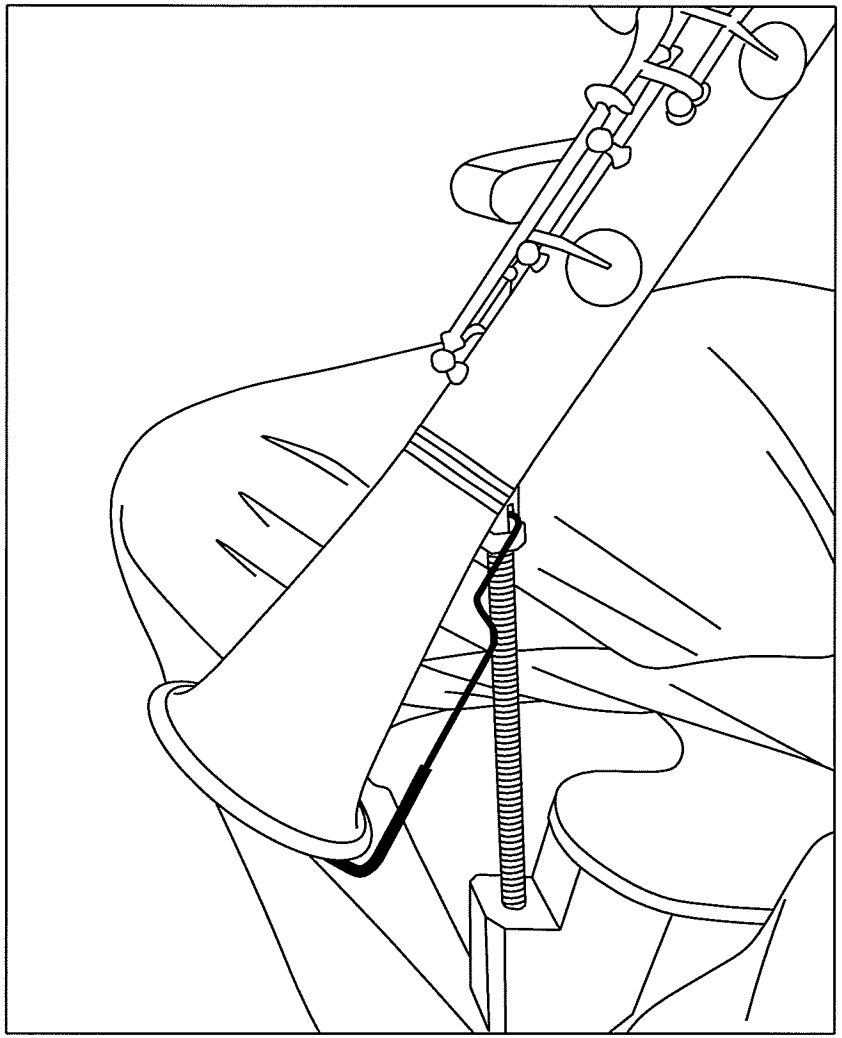

As shown in the photographs of FIGS. 7A and 7B, in this nonlimiting embodiment, the plate is sized to fit between a player's legs and a seat.

In one nonlimiting embodiment, the plate comprises an acoustically neutral material. In one nonlimiting embodiment, the plate comprises an acrylonitrile butadiene styrene plastic.

In one nonlimiting embodiment, the device 1 further comprises a first arm 10 extending either through the plate 5 or through an arm holder 25 mounted to the plate 5. The first arm comprises a distal end 11 and a proximal end 12 and is adjustable in an upward and downward direction and, in some embodiments, inward and outward direction from the plate 5. In one nonlimiting embodiment, the first arm comprises a threaded rigid metal rod ¼-½ inch in width. Length of the first arm is sufficient to provide for adjustment to all different ages and heights of the various players. Length may vary from about 5 to about 15 inches.

Figure 1A:
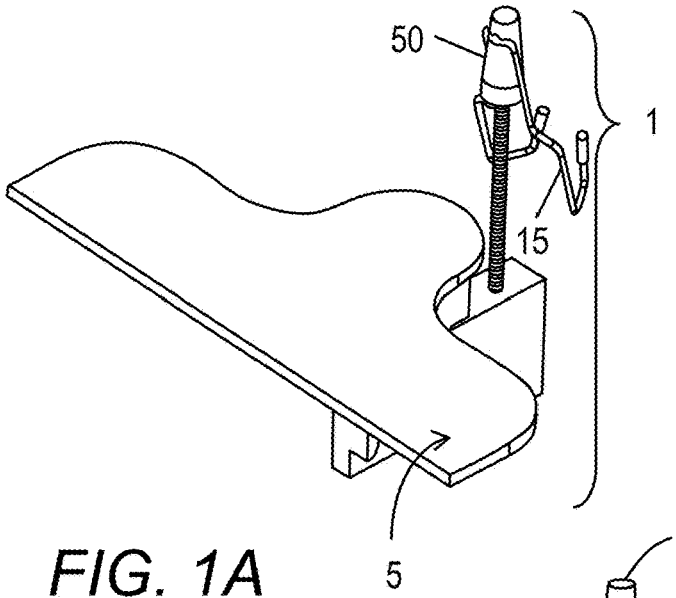
FIGS. 1A, 1B, 1C, 1D, 1E are diagrams depicting several views of one nonlimiting embodiment of an adjustable seat mounted support device of the present invention.
Figure 1B:
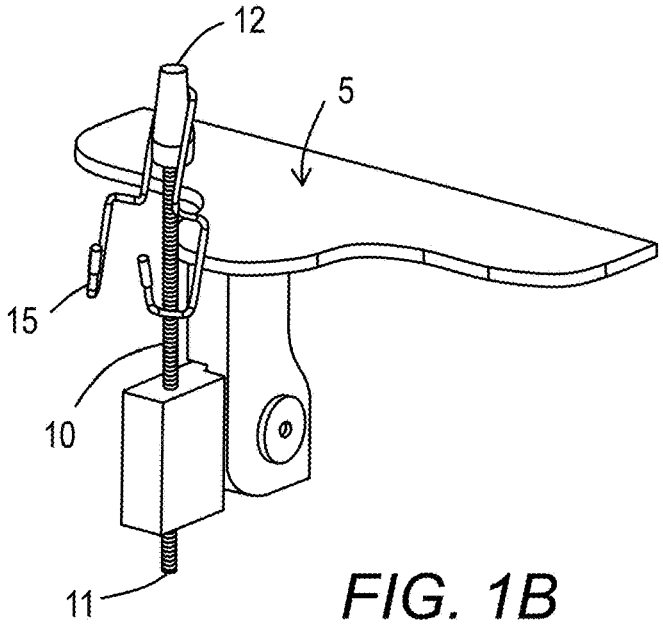
Figure 1C:
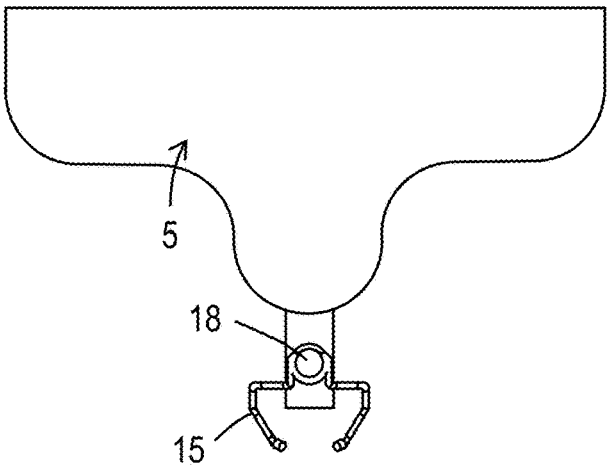
Figure 1D:
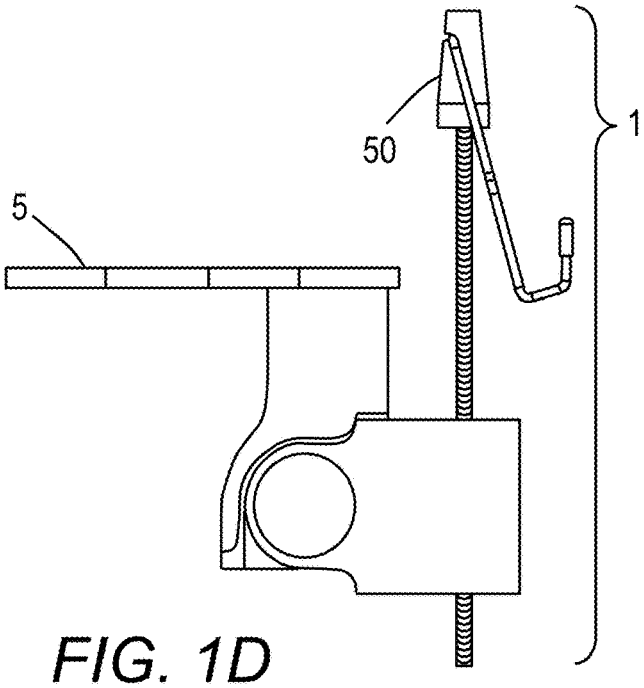
Figure 1E:
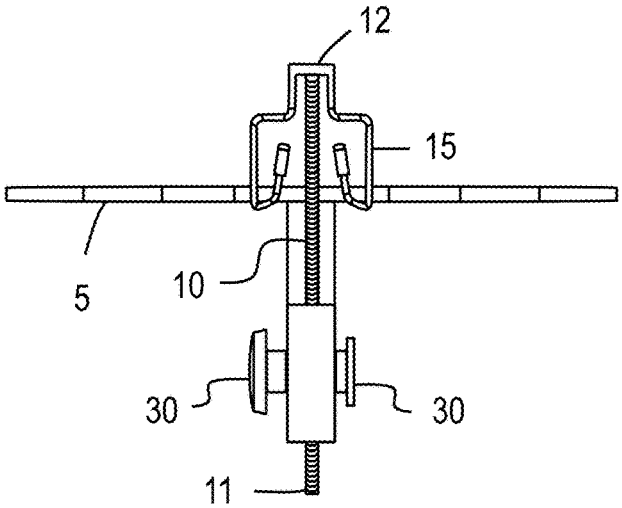
Figure 2A:
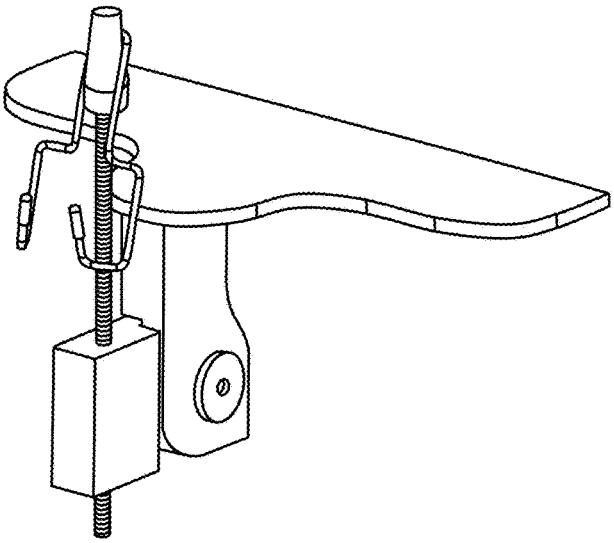
FIGS. 2A, 2B, 2C and 2D are diagrams depicting several views of another nonlimiting embodiment of adjustable seat mounted support device of the present invention with a hinge allowing for adjustment of the arm in an inward and outward direction.
Figure 2B:
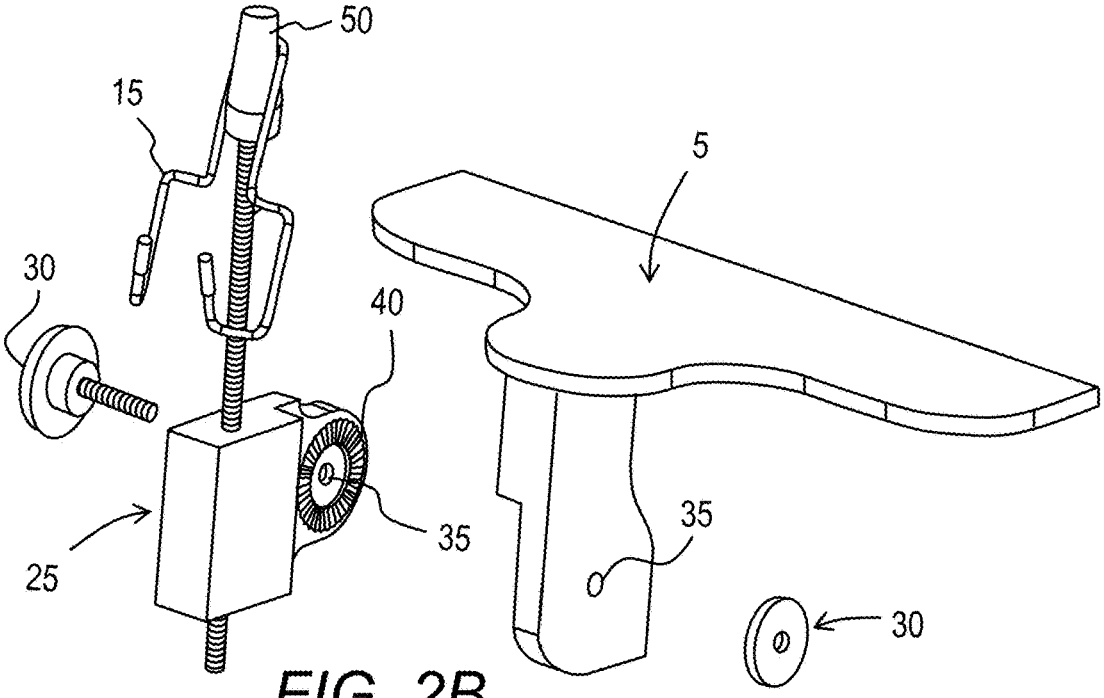
Figure 2C:
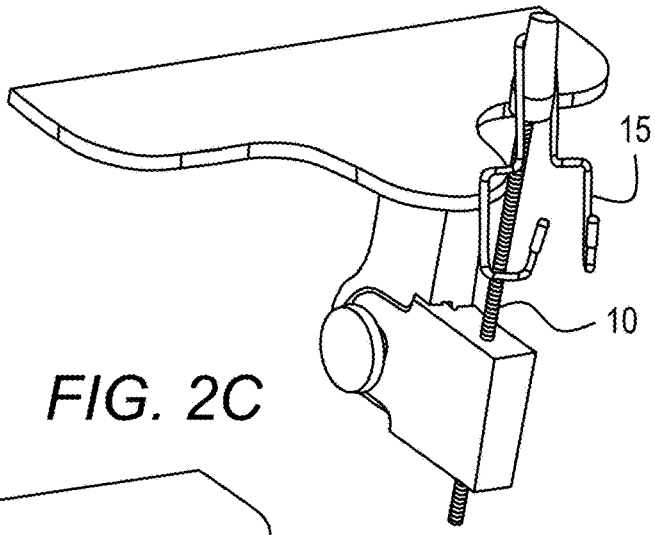
Figure 2D:
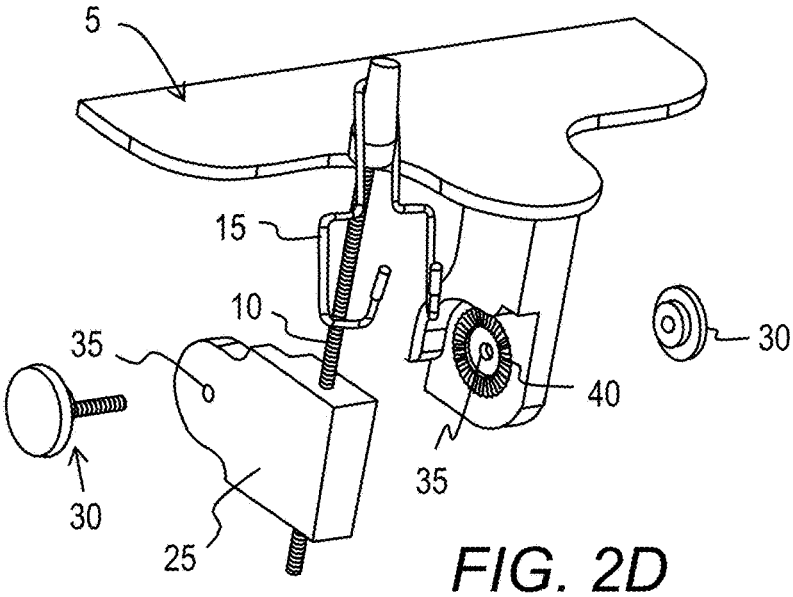
Figure 3:
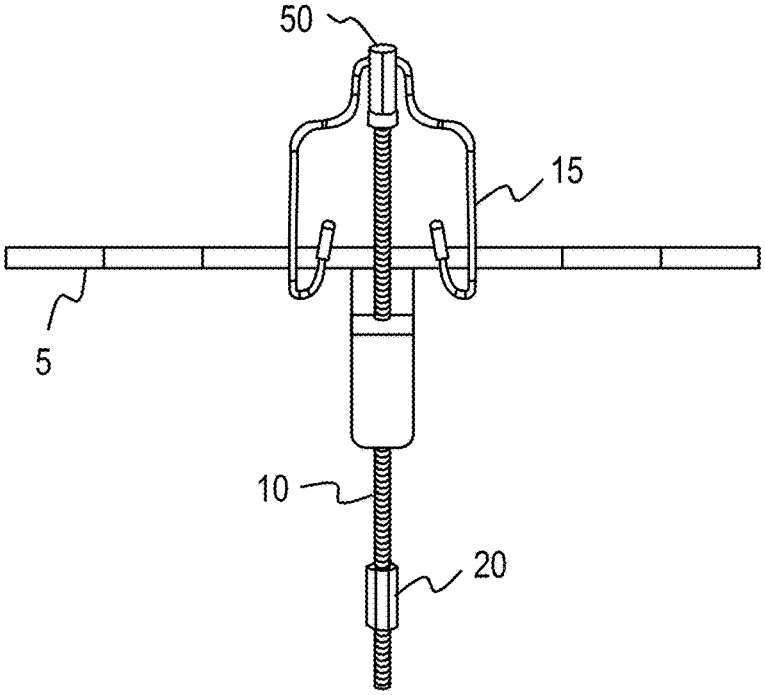
FIG. 3 is a diagram depicting a view of a nonlimiting embodiment of an adjustable seat mounted support device with arm which adjusts upward and downward and can be fixed in place once adjusted to the player via a nut.

In one nonlimiting embodiment, height of the first arm adjusts via sliding of the first arm up or down through a hole 18 (see FIG. 1C) in the plate or arm holder through which the arm is inserted. In one nonlimiting embodiment, as depicted in FIG. 3, the first arm is fixed once adjusted in the upward or downward direction for the player via a nut 20.

In one nonlimiting embodiment, the first arm is adjustable in an inward or outward direction from the plate. In one nonlimiting embodiment, this inward and outward directional adjustment is achieved via an arm holder 25 which is adjustably fixed to the plate via a screwing means 30 which extends through a hole 35 in the arm holder 25 and the plate 5. In one nonlimiting embodiment, the arm holder and plate each comprise a means to eliminate slip and/or create friction, such as, but not limited to, a gear, beveled gear, clutching means, or rubber or plastic non-slip material so that adjustment of the inward and outward directional adjustment of the first arm is better controlled and does not slip.

In one nonlimiting embodiment, the first arm is adjustable in an upward or downward direction and an inward or outward direction from the plate.

The device further comprises a hook 15 swivably attached to the proximal or distal end of the arm 10.

The hook is sized to engage a rim of a bell of a musical instrument at least one point (see FIGS. 7A and 7B and FIGS. 4A-5B). In one nonlimiting embodiment the hook is comprised of metal. In one nonlimiting embodiment, at least a portion of the metal hook is coated in plastic to avoid any scratching of the bell. In one nonlimiting embodiment the hook is made of plastic. In one nonlimiting embodiment, the hook comprises a configuration to engage with at least two points of the bell to provide stability and support.

In one nonlimiting embodiment, the hook is attached via a hook holder 50.

Alternatively, in some nonlimiting embodiments, instead of a hook holder, the adjustable support device may comprise a second arm 60 with a proximal end 61 and a distal end 62 attached at its proximal end via a universal joint 65 or similar means to the first arm and a hook, and in some embodiments stabilizing means 70, adjustably attached via a stabilizing bar 80 and attachment means 75, i.e. a screw, in an upward and downward direction with respect to the second arm at the distal end of the second arm. See FIGS. 5A and 5B.

Devices of the present invention can be used to alleviate stress and strain on hands, arms and/or shoulders of a musician during playing of a musical instrument with a bell-shaped portion such as, but in no way limited to a clarinet, bass clarinet, oboe, saxophone or bassoon. In this method, the musician either fits the plate of the adjustable seat mounted support device of the present invention between his or her legs and their seat or mounts the device to a seat or stand. The player then adjusts the device so that the musical instrument, when engaged via its bell in the swivably attached hook of the device, is at the proper position for playing by the musician. Since the device bears the majority of the weight of the instrument and steadies the instrument, there is less stress and strain on the hands, arms and shoulders of the player. Once adjusted to a selected player, the device can be used multiple times without further adjustment.

In addition, the device of the present invention can be used to assist the player with accurate placement of the instrument for optimum playing. Such placement is referred to as the correct embouchure. In this method, the musician either fits the plate of the adjustable seat mounted support device of the present invention between his or her legs and their seat or mounts the device to a seat or stand. The player, or in some cases a teacher, then adjusts the device so that the instrument, when engaged via its bell in the swivably attached hook of the device, is at the proper position for playing by the musician. Once adjusted to a selected player, the device can be used multiple times without further adjustment.

Further, the devices can be used for assisting a musician in need thereof with stabilization of the instrument during play. In this method, the musician either fits the plate of the adjustable seat mounted support device of the present invention between his or her legs and their seat or mounts the device to a seat or stand. The player then adjusts the device so that the instrument is engaged via its bell in the hook of the device and in some embodiments secured at a portion of the instrument above the bell in the stabilizing means at the proper position for playing by the musician. This method allows musicians with limited use or no use of one of their arms or hands to still play their instrument.

The device of the present invention can be used with all makes and models of wind instruments with bell-shaped portions. The instruments do not need to undergo any kind of technical modifications for this device.

The device of the present invention is useful for players with a medical history of thumb, finger, hand, wrist, elbow, shoulder, neck, or back injuries who wish to prevent further injuries, players who are currently healthy and wish to avert preventable future injuries, players who sense they are nearing the end of a career that they would like to extend as long as possible; players who find neck straps inadequate for the level of support, stability, and control they would like to experience; players with limited use or no use of one of their arms or hands; players who want to get the most out of their practice time with the least amount of wear and tear on their hands and joints; and teachers seeking a practice tool that will enable their students to consistently maintain their best posture, embouchure, and instrument and hand position as easily at home as in the studio.

What is claimed is:

1. A support device for a musical wind instrument with a bell-shaped portion, said device comprising a hook sized to engage a rim of a bell of the musical wind instrument with a bell-shaped portion at least one point attachable to a stand or arm.

2. The support device of claim 1 further comprising a means in addition to the hook for stabilizing the musical instrument above the bell portion.

3. The support device of claim 1 further comprising a first arm with a distal end and a proximal end with hook holder or second arm on said distal end or said proximal end for swivable attachment of the hook.

4. An adjustable seat mounted support device for a wind instrument with a bell-shaped portion, said device comprising: a means for fixing the device to a seat; a first arm with a distal end and a proximal end adjustably attached to the fixing means at its distal end and extending upward and outward from the fixation means; and a hook or second arm with an adjustably attached hook swivably attached to the proximal or distal end of the first arm via a hook holder or universal joint and sized to engage a rim of a bell of the wind instrument with a bell-shaped portion at least one point.

5. The device of claim 4 further comprising a means in addition to the hook for stabilizing the wind instrument with a bell-shaped portion above the bell portion.

6. The adjustable seat mounted support device of claim 4 wherein the fixing means comprises a plate that fits between a player's legs and the seat.

7. The adjustable seat mounted support device of claim 4 wherein the hook engages the rim of the bell of the musical instrument at two points.

8. The adjustable seat mounted support device of claim 4 wherein the first arm is adjustable in an upward or downward direction from the fixing means.

9. The adjustable seat mounted support device of claim 4 wherein the first arm is adjustable in an inward or outward direction from the fixing means.

10. The adjustable seat mounted support device of claim 4 wherein the first arm is adjustable in an upward or downward direction and an inward or outward direction from the fixing means.

11. The adjustable seat mounted support device of claim 4 wherein said device comprises an acoustically neutral material.

12. The adjustable seat mounted support device of claim 11 wherein said device comprises an acrylonitrile butadiene styrene plastic.

13. A method for alleviating stress on hands, arms and/or shoulders of a musician during playing of a wind instrument with a bell-shaped portion, said method comprising adjusting the device of claim 1 so that the wind instrument with a bell-shaped portion, when engaged via its bell in the swivably attached hook of the device, is at the proper position for playing by the musician.

14. The method of claim 13 wherein the hook engages the rim of the bell of the musical instrument at two points.

15. A method for positioning a wind instrument with a bell-shaped portion for optimal play by a musician, said method comprising adjusting the device of claim 1 so that the instrument, when engaged via its bell in the swivably attached hook of the device, is at the proper position for playing by the musician.

16. The method of claim 15 wherein the hook engages the rim of the bell of the musical instrument at two points.

17. A method for assisting a musician in need thereof with stabilization of a wind instrument with a bell-shaped portion during play, said method comprising adjusting the device of claim 1 so that the musical instrument, when engaged via its bell in the swivably attached hook and at a portion of the musical instrument above the bell via a stabilization means of the device, is at the proper position for playing by the musician.

* * * * *